US006702596B2

(12) United States Patent
Auclair

(10) Patent No.: US 6,702,596 B2
(45) Date of Patent: Mar. 9, 2004

(54) CABLE SHIELD GROUND CONNECTOR

(75) Inventor: William T. Auclair, Winsted, CT (US)

(73) Assignee: Electric Motion Company, Inc., Winsted, CT (US)

( * ) Notice: Subject to any disclaimer, the term of this patent is extended or adjusted under 35 U.S.C. 154(b) by 0 days.

(21) Appl. No.: 10/189,725

(22) Filed: Jul. 3, 2002

(65) Prior Publication Data

US 2004/0005796 A1 Jan. 8, 2004

(51) Int. Cl.[7] ..... H01R 4/66
(52) U.S. Cl. ..... 439/99
(58) Field of Search ..... 439/98, 99, 411, 439/412, 393

(56) References Cited

U.S. PATENT DOCUMENTS 3,778,749 A * 12/1973 Kapell ..... 439/411
4,353,612 A * 10/1982 Meyers ..... 439/99
4,449,768 A * 5/1984 Koncelik et al. ..... 439/98
4,561,708 A * 12/1985 Sorlien et al. ..... 439/99
4,571,013 A 2/1986 Suffi et al. ..... 439/99
4,895,525 A * 1/1990 Leonardo ..... 439/99
5,722,840 A * 3/1998 Auclair et al. ..... 439/98
6,322,378 B1 11/2001 Auclair ..... 439/99

* cited by examiner

*Primary Examiner*—Tulsidas Patel
(74) *Attorney, Agent, or Firm*—Alix, Yale & Ristas, LLP

(57) ABSTRACT

A cable shield ground connector includes an inner part and outer part clamped together by means of a threaded stud carried by the inner part engaged by a nut. The inner part defines a smoothly tapered, arcuate, conductor-receiving trough portion configured for insertion between the conductors of a service cable and the cable shield. A threaded stud and tang project from the inner part in a direction opposite from the opening defined by the trough portion. A plurality of teeth project integrally from fillets of the outer part in parallel rows to define a jacket-gripping portion of the outer part. The channel-shaped outer part defines a guide for receiving the tang of the inner part. The stud passes through an aperture defined by the web of the outer part and the tang is received in the guide, thereby assuring longitudinal alignment of the inner and outer connector parts.

17 Claims, 5 Drawing Sheets

CABLE SHIELD GROUND CONNECTOR

BACKGROUND OF THE INVENTION

1. Field of the Invention

This invention relates generally to devices for implementing a ground connection between a metallic shield of a service cable and a common ground point. More particularly, the present invention relates to a two-part ground clamp connector which mounts to a buried service cable and includes an attachment point for connection of a flexible conductor to establish continuity with a common ground point.

2. Description of the Related Art

A number of devices have been employed for connecting a ground wire with the tubular ground shields of service cables. Most conventional devices employ clamp assemblies of various forms. In applications to which the present invention relates, the cables, clamping devices and associated interconnections are ordinarily positioned within a cabinet, housing or other enclosure to provide protection from the ambient environment. The service cables to which the present invention relates are buried service cables that enter the enclosure for the purpose of interconnection and/or grounding at specified intervals. A number of conventional designs are configured to secure the service cable rigidly or semi-rigidly to a ground point within the enclosure. For such designs, damage to the cables can occur when the enclosure is subject to intense environmental changes and the cables are fixedly positioned relative to the housing. For example, it is not uncommon for such enclosures to heave as a result of frost while the service cables are frozen in position in the ground.

To avoid disruptions of the ground connection possibly caused by shifting of the enclosure relative to the buried cables, it has become common to establish a ground connection with a flexible wire between the cable and a common ground point. For example, U.S. Pat. No. 4,895,525 illustrates a two-part cable shield grounding clamp connector including a threaded stud to which such a flexible grounding wire can be attached. This particular cable shield grounding clamp connector utilizes arcuate inner and outer plates with the inner plate provided with teeth to scrape the inner surface of a metallic shield to establish improved electrical contact. The '525 patent illustrates a tang projecting outwardly for longitudinally indexing the inner part of the illustrated grounding clamp connector relative to the cable jacket, but lacks means for longitudinally aligning the inner and outer connector parts. Further, the teeth provided on the inner part of the '525 connector may interfere with installation by, for example, catching and crumpling the thin metallic shield.

Another representative example is described in U.S. Pat. No. 4,571,013, which discloses a connector for cable shields in the form of a strip of metal bent into a U-shape with a stud extending through the legs to engage a nut that clamps the legs together. Teeth project inwardly from each of the inner and outer legs for gripping the cable shield and jacket to resist pull out. By forming the connector from a single bent strip of metal and passing the stud through both legs, the '013 patent illustrates one approach to maintaining alignment between the inner and outer portions of a cable shield connector. The teeth on the inner leg may also catch the shield during installation. Additionally, once compressed by the nut and stud, the connector may prove difficult to remove without damage to the cable shield.

An alternative approach is exemplified by U.S. Pat. Nos. 5,722,840 for a conductor protector and 6,322,378 for a conductor protector for ground clamp, both assigned to the assignee of the present invention. These patents disclose a ground clamp that surrounds a cable and a received conductor protector. The smooth, arcuate conductor protector is inserted beneath the cable jacket to establish conductive relationship with the ground shield and substantially surround the conductors to protect them from crushing when the clamp is secured around the service cable. These ground clamp assemblies have proven appropriate for their intended use and have been commercially successful. However, they can be costly to manufacture and time consuming to install. Further, the exterior portion of the clamp occupies significant space in what are typically confined enclosures.

There is a need in the art for a less complicated and less costly connector for establishing a reliable electrical connection between a common ground point and the metallic shield of a buried service cable. The connector should be easily installed and removed with minimal damage to the metallic shield of the service cable. The connector should also preferably be of compact design.

SUMMARY OF THE INVENTION

A cable shield ground connector in accordance with one embodiment of the present invention comprises an inner part defining a longitudinally extending cable-receiving trough. A threaded stud is fixed to an opposite side of the inner part projecting generally perpendicularly and away from the cable-receiving trough. The trough narrows or converges to a point at one end to ease insertion of the inner part between the core conductors of the cable and the conductive shield. Longitudinally opposed to the point is a tang projecting away from the trough in a similar direction to the threaded stud. The trough is substantially smooth on its inner and outer surfaces as well as the edges leading to the point. The arcuate configuration of the trough enhances the rigidity of the inner part.

A connector outer part includes an aperture for receiving the threaded stud and a guide for receiving the tang projecting from the connector inner part. The outer part is primarily in the form of a longitudinally extending channel, e.g., a substantially planar web connecting longitudinally extending fillets that project generally perpendicular to the web. The fillets strengthen the outer part such that it is substantially rigid along its length. A plurality of teeth extend integrally from each fillet at a jacket-gripping end of the outer part opposite the guide. The teeth are sharp and angled toward the guide to provide improved pull out resistance for the connector.

In preparation for assembling the connector to a cable shield, the cable jacket and metallic shield are slit over a short distance to allow insertion of the connector inner part. The point of the conductor-receiving trough is inserted between the conductors (the core) of the service cable and the surrounding metallic shield, which is in turn surrounded by a thick plastic or rubber jacket. Electrical continuity is established between the conductive connector inner part as it contacts the inner surface of the metallic shield.

A cable shield ground connector in accordance with the illustrated embodiment of the present invention is preferably inserted circumferentially opposite the slit. As a result, the connector is engaged with an intact portion of the metallic shield and cable jacket. The connector inner part is inserted into the cable until the stud contacts the end of the cable jacket. The connector outer part is then placed over the outwardly projecting stud and tang with the jacket gripping end teeth against the outside of the cable jacket. Together, the threaded stud and tang ensure longitudinal alignment of the connector inner part and outer parts. A nut engages the threaded stud to compress the connector outer part against the connector inner part. Tightening the nut causes the teeth projecting from the outer part to dig into the jacket of the service cable. The teeth are angled and pointed so that force exerted to pull the connector out of the cable actually causes the teeth to dig into the jacket. The compressed engagement between the outer and inner connector portions ensures that a large area of the metallic shield is in surface to surface contact with the received inner connector part. A flexible ground conductor is preferably affixed to the threaded stud prior to tightening the clamping nut.

An object of the present invention is to provide a new and improved cable shield ground connector that is efficiently installed and removed.

Another object of the present invention is to provide a new and improved cable shield ground connector that exhibits improved pull out resistance.

A further object of the present invention is to provide a new and improved cable shield ground connector of efficient and economic design.

A yet further object of the present invention is to provide a new and improved cable shield ground connector of compact configuration.

BRIEF DESCRIPTION OF THE DRAWINGS

These and other objects, features and advantages of the invention will become readily apparent to those skilled in the art upon reading the description of the preferred embodiment, in conjunction with the accompanying drawings, in which.

DETAIL DESCRIPTION OF THE PREFERRED EMBODIMENTS

Figure 1:
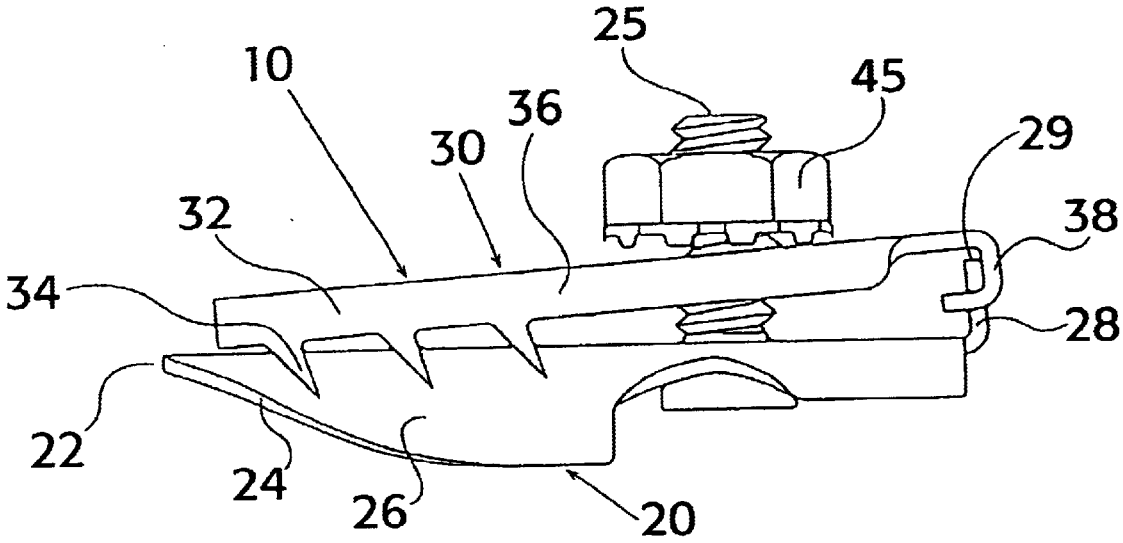
FIG. 1 is a side view of one embodiment of an inventive cable shield ground connector.

An embodiment of a cable shield ground connector is illustrated in FIGS. 1–11 and is generally designated by the numeral 10. The connector has an inner part 20 configured to be inserted between the conductive metallic shield and the conductors, or core of a service cable. When inserted, a conductor-receiving trough 26 of the inner part 20 surrounds a majority of the circumference of the core. An outer part 30 of the connector is configured to align longitudinally with the inner part 20 along the outside of the service cable. A stud 25 projects from the inner part through an aperture 35 in the outer part 30. A nut 45 or other fastening means engages the stud 25 to clamp the outer part 30 to the inner part 20. As will be more fully described below, the inner part 20 is in electrical contact with the cable shield, while the outer part 30 grips the cable jacket in a manner that resists forces acting to pull the inner part from inside the cable. The outer part 30 compresses the cable shield against the inner part 20 to ensure electrical continuity over a large area of a received portion (the conductor-receiving trough) of the inner part 20.

Figure 2:
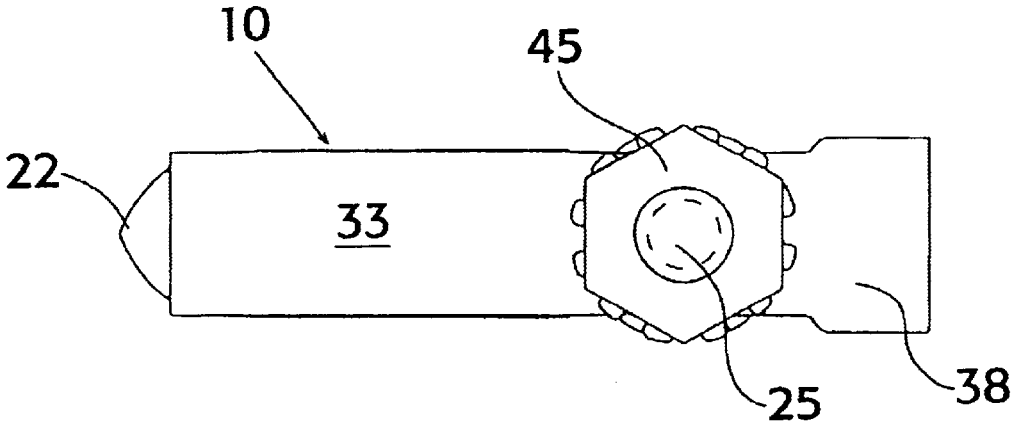
FIG. 2 is a top view of the cable shield ground connector of FIG. 1.
Figure 3:
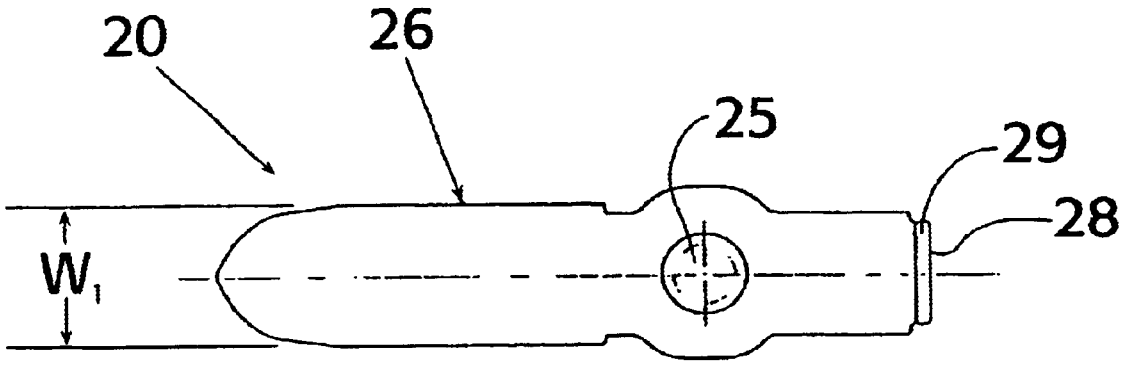
FIG. 3 is a top view of the inner part of the cable shield ground connector illustrated in FIG. 1.
Figure 4:
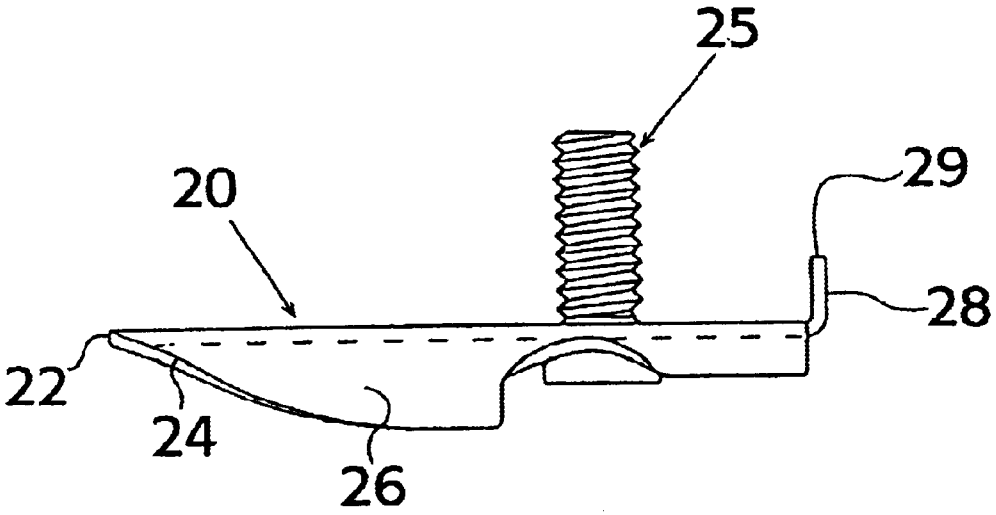
FIG. 4 is a side view, partly in phantom, of the inner part of FIG. 3.
Figure 7:
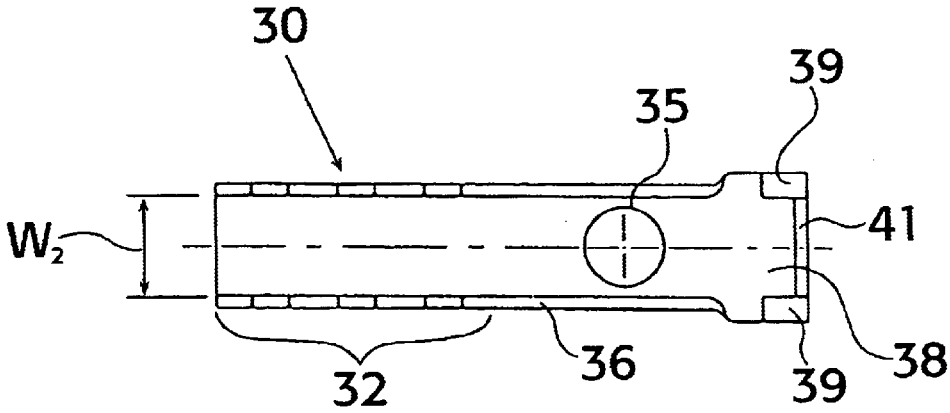
FIG. 7 is a bottom view of the outer part of FIG. 5.

FIGS. 1, 2 and 7 illustrate an embodiment of the cable shield ground connector 10 as an assembly. The inner part 20 extends from a pointed insertion tip 22 to a tang 28 projecting generally parallel to the threaded stud 25. The tang 28 projects to an outward end 29 that interacts with the connector outer part 30 as will be discussed below. The inner part 20 is inserted between the shield and the core of a cable until the stud 25 contacts the cable jacket. The threaded stud 25 provides a connection point for a flexible ground conductor. The stud 25 also serves as an anchor for clamping the outer part 30 to the inner part 20.

Figure 9:
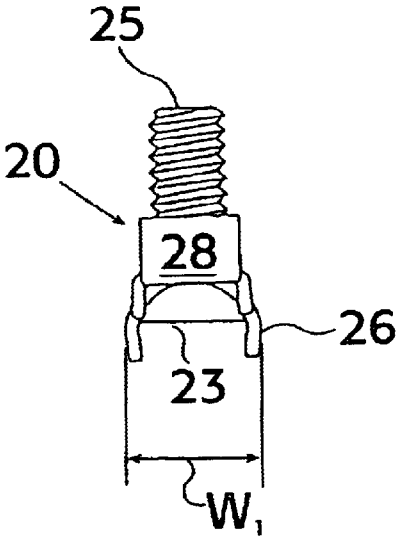
FIG. 9 is a right end view of the inner part of FIG. 4.

The inner part 20 flares from the tip 22 to define a conductor-receiving trough 23. The flared portion 26 of the inner part 20 has an arcuate, or semi circular configuration when viewed in section, as best illustrated in FIGS. 7 and 9. This arcuate configuration generally matches the sectional shape of a service cable and enhances the longitudinal rigidity of the inner part 20. The matched sectional configuration ensures maximum surface to surface contact between the cable shield and the outside surface of the flared portion 26 of the inner part 20. The flared portion 26 inside and outside surfaces, as well as the edges 24 are substantially smooth. The edges 24 meet at an acute angle to define the insertion point 22. This configuration ensures ease of insertion and minimizes the chances that the inner part 20 will catch or crumple the cable shield during insertion.

Figure 10:
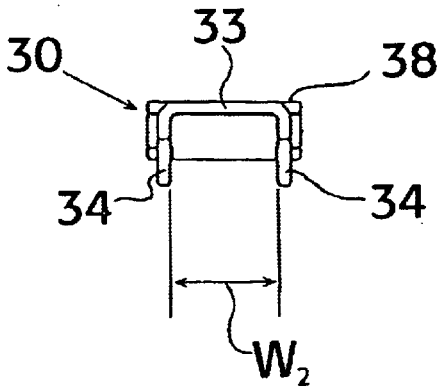
FIG. 10 is a left end view of the outer part of FIG. 5.

The connector outer part 30 is configured to grip the jacket of the service cable and force the metallic shield into contact with the outside surface of the flared portion 26 of the inner part 20. The outer part 30 is generally channel-shaped in cross section along most of its length, as best illustrated in FIGS. 7 and 10. The term "channel-shaped" is used to describe the shape of a member having a generally planar web 33 connecting longitudinally extending fillets 36. This configuration is commonly used in structural steel members, in part because of its rigidity, or stiffness.

One end of the outer part 30 is configured as a guide 38 for receiving the tang 28 projecting from the inner part 20. To form the guide 38, the fillets 36 end and the generally planar web 33 is cut and bent to form arms 39 that extend back along the web 33 in spaced relationship from and generally parallel to the web 33. The arms 39 are laterally separated by a gap configured to closely receive the lateral width of the tang 28. The arms 39 are connected by a web portion 41 that is generally perpendicular to the main web 33 of the outer part 30. This web portion 41 also acts as a longitudinal end of the guide 38. Thus, the guide 38 retains a received tang 28 laterally between the arms 39 and longitudinally adjacent the web portion 41.

As best illustrated in FIG. 1, the outer part 30 is longitudinally aligned with the inner part 20 at the threaded stud 25/aperture 35 engagement and the tang 28/guide 38 engagement. These two points of alignment simplify assembly and installation of the connector 10 by resisting misalignment while the nut 45 is tightened.

FIG. 1 also illustrates that the tang end 29 engages the web 33 at the guide 38 to define a pivot point for the outer part 30 relative to the inner part 20. Force exerted on the outer part 30 by tightening the nut 45 over the stud 25 forces the jacket gripping portion 32 of the outer part 30 toward the cable jacket and received trough portion 26, with the outer part pivoting about the tang end 29/web 33 contact point. This motion of the outer part 30 relative to the received trough portion 26 of the inner part ensures that the teeth 34 dig into the jacket and also forces the jacket and shield into contact with the outside surface of the received trough portion 26. Without the tang end 29/web 33 pivot point, the inner and outer parts would pivot about the stud 25/nut 45 point of contact, producing a less predictable and therefore less reliable engagement between the connector 10 and a cable jacket/cable shield.

Figure 5:
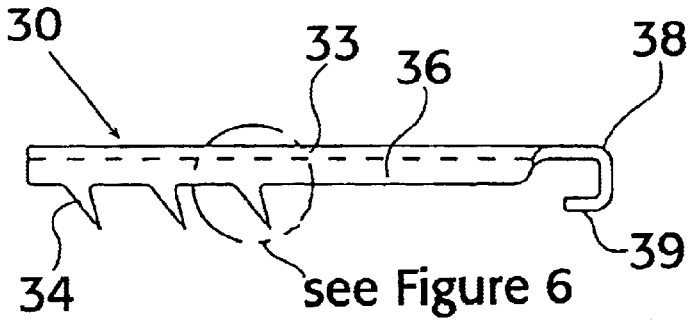
FIG. 5 is a side view, partly in phantom, of the outer part of the cable shield ground connector of FIG. 1.
Figure 6:
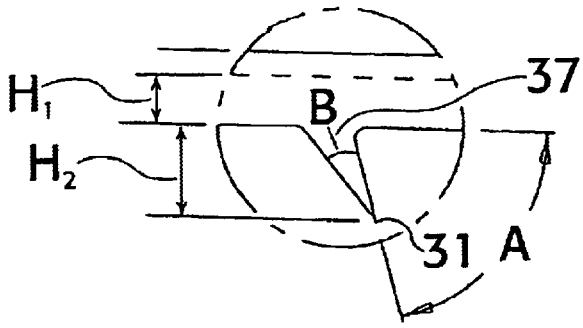
FIG. 6 is an enlarged view of one tooth of the outer part illustrated in FIG. 5.

The illustrated embodiment of the jacket-gripping portion 32 of the outer part 30 includes two parallel rows of fang-like, piercing teeth 34. Each row of teeth 34 integrally projects from a longitudinally extending fillet 36. FIGS. 5 and 6 best illustrate the configuration of the teeth 34. Each tooth 34 extends from a root 37 to a terminal point 31. The point 31 is offset toward the guide end of the outer part relative to the root 37 producing an acute angle A between the guide-edge of the tooth and the fillet 36. The teeth are preferably aggressively shaped, e.g., sharp, with an acute internal angle B of between 15° and 50°. Another preferred aggressive feature of the teeth 34 is that they project from the fillet 36 a distance $H_2$ at least approximately twice the height $H_1$ of the fillet 36. Since the teeth 34 are located only on the outer part 30, they can be far more aggressively configured than teeth located on a received portion of a cable shield ground clamp connector.

Figure 11:
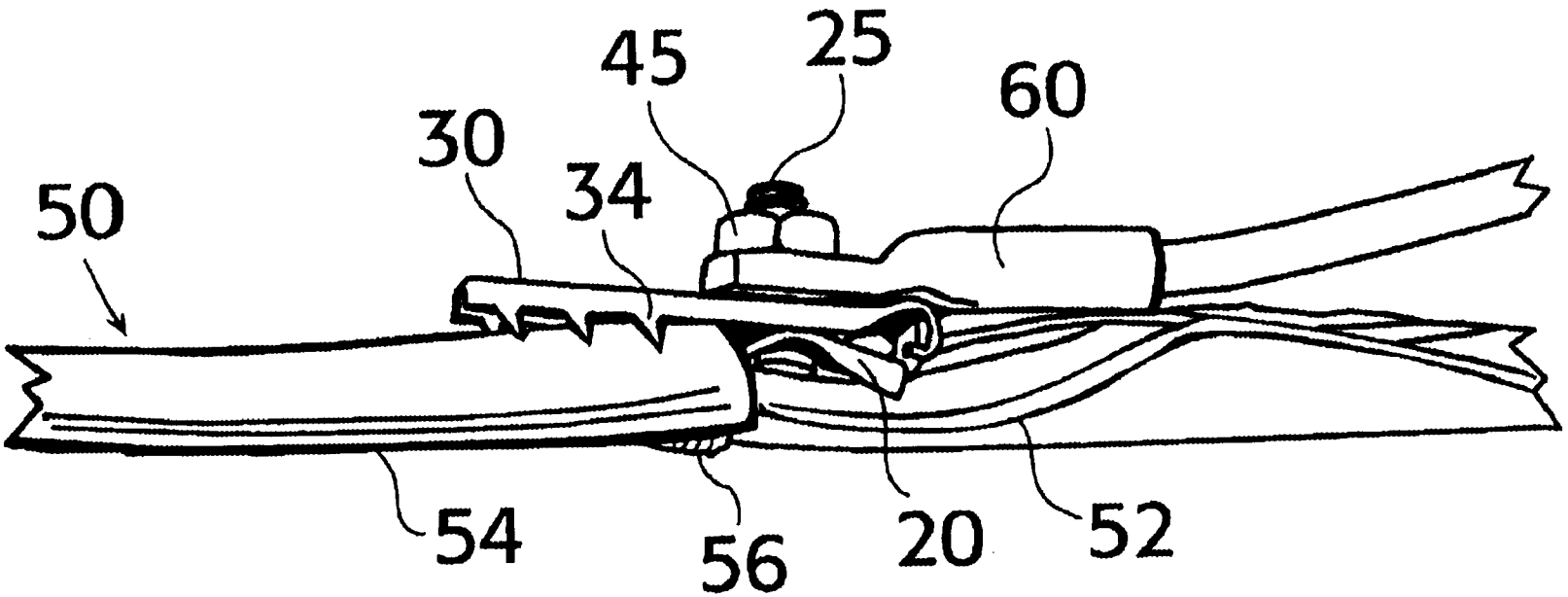
FIG. 11 is a perspective side view of the cable shield ground connector of FIGS. 1, 2 and 7 mounted to a service cable and a ground wire.

Teeth so configured have exceptional pull-out resistance due to the fact that they will actually dig in and actively engage the cable jacket in response to force exerted to pull the connector 10 from its installed position (as illustrated in FIG. 11). However, upon loosening of the nut 45, the jacket-gripping portion 32 is easily disengaged from the cable jacket 54, in part because of the two part configuration of the connector 10.

Figure 8:
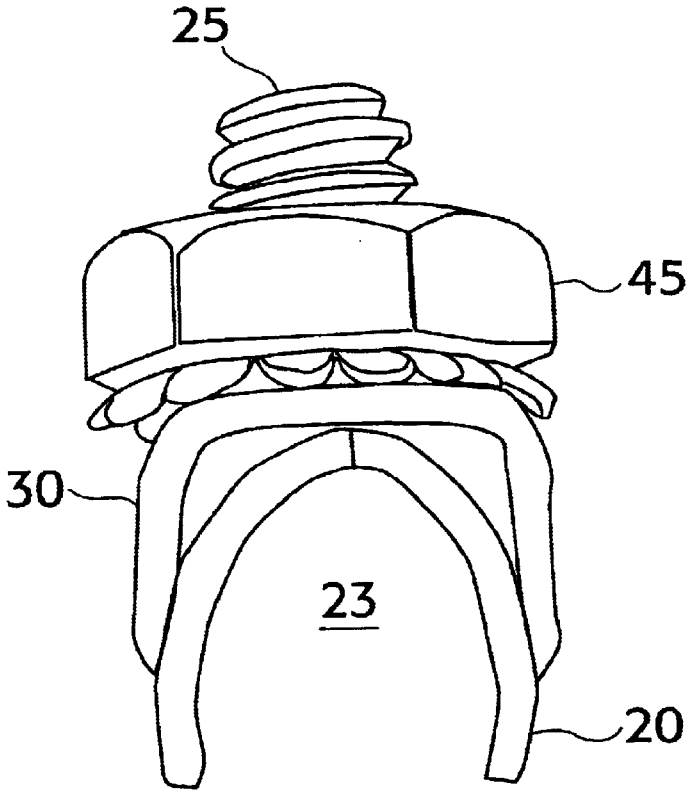
FIG. 8 is a perspective end view of an embodiment of the inventive cable shield ground connector.

As is best shown in FIGS. 8–10, the outer part 30 is generally rectangular or channel shaped in cross-section while the inner part 20 is generally arcuate in cross-section. FIGS. 7 and 10 illustrate the lateral width $W_2$ between the inside edges of the two rows of teeth 34 making up the jacket-gripping portion 32 of the outer part 30. FIG. 9 illustrates the lateral width $W_1$ of the trough portion 26 of the inner part 20. $W_1$ is less than $W_2$, which produces the functional relationship (best illustrated in FIG. 8) that the jacket-gripping portion 32 of the outer part fits over the trough portion 26 of the inner part 20. It should be noted that the fillets 36 need not be precisely perpendicular to the web 33 of the outer part 30. An angle of the fillets 36 relative to the web 33 of at least approximately 90° will provide adequate stiffness to the outer part 30.

When the connector 10 is assembled to a service cable as shown in FIG. 11, the jacket-gripping portion 32 engages the jacket 54 and the cable shield inside to stretch them over and against the outside surface of the trough portion 26. The relative positions of the longitudinally opposed ends of the inner part 20 and outer part 30 are determined by the tang end 29/web 33 pivot point so that the jacket-gripping portion 32 and received trough portion 26 are forced together when the nut 45 is tightened. The shapes and relative relationships described ensure intimate surface to surface contact between the outside surface of the trough portion 26 and the cable shield over a large surface area. Such contact helps ensure reliable electrical continuity between the cable shield and a ground wire 60 fixed to the assembled connector 10.

With specific reference to FIGS. 1, 3, 4 and 11, the connector inner part 20 comprises a tapered arcuate conductor-receiving trough portion 26 for insertion between the conductors 52 and the metallic shield 56 of a service cable 50. In this position, the trough portion 26 is configured to surround a majority of the circumference of the received conductors. In other words, the trough portion 26 is configured to have an arcuate extent of at least approximately 180°. This configuration improves the longitudinal stiffness of the inner part 20 and affords some protection to the conductors as they emerge from the service cable. Longitudinally opposite from the trough portion 26, the inner part 20 becomes channel-shaped in section as best seen in FIG. 9. Intermediate the trough portion 26 and tang 28, the inner part supports a rigidly fixed threaded stud 25. Other means for clamping the inner part 20 to the outer part 30 may occur to one of skill in the art. Further, means other than a threads on the stud 25 and a complementary nut 45 may occur to those skilled in the art for engaging the stud as an anchor point for the assembled connector 10.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A cable shield ground connector comprising:

an inner part having an arcuate conductor-receiving trough portion at one end and a tang at an opposite longitudinal end from the trough portion, said trough portion defining an inner channel along an inner surface and converging to an insertion point, said tang projecting opposite to said channel, said inner part including a stud projecting away from the trough channel, said stud longitudinally positioned intermediate the insertion point and the tang;

an outer part extending longitudinally between a jacket-gripping portion and guide means for receiving said tang, said outer part defining a stud aperture intermediate said guide means and jacket-gripping portion, said outer part including laterally spaced longitudinally extending fillets connected by a web, said jacket-gripping portion comprising a plurality of teeth integrally extending from said fillets; and fastening means engagable with said stud, wherein said stud passes through said aperture and said tang is received in said guide means to align said outer part with said inner part while said fastening means engages said stud to clamp said outer part toward said inner part.

2. The cable shield ground connector of claim 1, wherein said trough portion has a maximum lateral arcuate extent of at least 180°.

3. The cable shield ground connector of claim 2, wherein said trough portion narrows from said maximum lateral arcuate extent to a point defined by edges of the trough portion, said edges converging at an acute angle.

4. The cable shield ground connector of claim 1, wherein each of said teeth extend from a root at a junction with a said fillet to a point and said point is closer to said guide means than said root.

5. The cable shield ground connector of claim 1, wherein each of said fillets have a height measured generally perpendicular to said web and said teeth project from said fillet a distance equal to at least approximately twice the height of the fillet.

6. The cable shield ground connector of claim 1, wherein said trough portion is generally semi-circular in cross section and said outer part has a generally rectangular channel-shape in cross section.

7. The cable shield ground connector of claim 6, wherein said trough portion has a first lateral width and said jacket-gripping portion has a second lateral width such that said teeth have a lateral spacing between an inner edge of a point of laterally opposed teeth substantially equal to said first lateral width.

8. The cable shield ground connector of claim 1, where said tang contacts said web to define a pivot point for said outer part such that force exerted by said fastener means pivots said jacket gripping portion of said outer part toward an outer surface of said trough portion.

9. A cable shield ground connector comprising:

an inner part comprising a longitudinally extending trough portion configured to surround at least a semi-circumference of a received conductor, a substantially planar tang projecting generally orthogonal to an axis of said trough and a stud fixed to said inner part and axially spaced from said tang and also projecting generally orthogonal to said trough axis;

an outer part comprising a generally planar web extending between two longitudinally extending fillets projecting substantially perpendicular to said web, said web defining a stud aperture between said fillets, a plurality of teeth integrally extending from laterally opposed end portions of each said fillet, said outer part including a guide for receiving said tang, said guide longitudinally spaced from said teeth; and fastener means for engaging the stud, wherein said stud is received through said stud aperture and said tang is received in said guide to maintain longitudinal alignment of said inner and outer parts while said fastener means clamps said outer part toward said inner part.

10. The cable shield ground connector of claim 9, wherein said trough portion has a first lateral width and the plurality of teeth are laterally separated by a second lateral width, said second lateral width being greater than said first lateral width.

11. The cable shield ground connector of claim 9, wherein said tang contacts said web to provide a pivot for said outer part relative to said inner part, whereby said teeth are moved toward said trough portion by force exerted on said outer part by said fastener means.

12. The cable shield ground connector of claim 9, wherein said stud is threaded and said fastener means comprises a nut threadably engagable with said stud.

13. The cable shield ground connector of claim 9, wherein said trough portion has an arcuate extent of at least 180°.

14. The cable shield ground connector of claim 9, wherein each of said teeth is defined by first and second edges extending from a tooth root at said fillet and meeting at a point, said first edge being oriented toward said guide, an acute angle being defined between said first edge and said fillet.

15. The cable shield ground connector of claim 9, wherein each tooth projects from a root at said point being closer to said guide than said root.

16. The cable shield ground connector of claim 9, wherein each said fillet projects a first height from said web measured generally perpendicular to said web and each said tooth projects a second height from said fillet, said second height being at least approximately twice said first height.

17. The cable shield ground connector of claim 9 wherein each of said teeth has a generally congruent fang-like shape.

* * * * *

UNITED STATES PATENT AND TRADEMARK OFFICE

CERTIFICATE OF CORRECTION

PATENT NO. : 6,702,596 B2
DATED : March 9, 2004
INVENTOR(S) : Auclair

It is certified that error appears in the above-identified patent and that said Letters Patent is hereby corrected as shown below:

Column 8,
Line 28, after "root at" insert -- said fillet to a point, --.

Signed and Sealed this

Third Day of May, 2005

JON W. DUDAS
*Director of the United States Patent and Trademark Office*